US009133605B2

(12) United States Patent
Pomeroy et al.

(10) Patent No.: US 9,133,605 B2
(45) Date of Patent: Sep. 15, 2015

(54) FLOW SENSING BASED VARIABLE PUMP CONTROL TECHNIQUE IN A HYDRAULIC SYSTEM WITH OPEN CENTER CONTROL VALVES

(75) Inventors: Paul Edward Pomeroy, Sandbach (GB); Robert Jonathan Valenta, Altrincham (GB); Mark Jervis, Billinge (GB)

(73) Assignee: HUSCO International, Inc., Waukesha, WI (US)

( * ) Notice: Subject to any disclaimer, the term of this patent is extended or adjusted under 35 U.S.C. 154(b) by 800 days.

(21) Appl. No.: 13/405,521

(22) Filed: Feb. 27, 2012

(65) Prior Publication Data

US 2013/0220425 A1 Aug. 29, 2013

(51) Int. Cl.
*F15B 11/16* (2006.01)
*E02F 9/22* (2006.01)

(52) U.S. Cl.
CPC ..... *E02F 9/2296* (2013.01); *E02F 9/2235* (2013.01); *F15B 11/162* (2013.01); *F15B 2211/20553* (2013.01); *F15B 2211/3116* (2013.01); *F15B 2211/3144* (2013.01); *F15B 2211/50536* (2013.01); *F15B 2211/781* (2013.01); *Y10T 137/0318* (2015.04); *Y10T 137/2605* (2015.04)

(58) Field of Classification Search
CPC ..... F15B 11/165; F15B 2211/20553; F15B 2211/3116; F15B 2211/40561
USPC ..... 60/445, 452; 91/516
See application file for complete search history.

(56) References Cited

U.S. PATENT DOCUMENTS 4,470,260 A 9/1984 Miller et al.
7,430,859 B2 * 10/2008 Jang et al. ..... 60/445

* cited by examiner

*Primary Examiner* — F. Daniel Lopez
(74) *Attorney, Agent, or Firm* — Quarles & Brady LLP

(57) ABSTRACT

A hydraulic system has a variable displacement pump that sends fluid from a tank into a supply conduit from which separate open-center control valves convey the fluid to each one of a plurality of hydraulic actuators. The control valves have open-center orifices connected in series between a bypass node and the tank, thereby forming a bypass passage. Pressure at the bypass node controls displacement of the pump. A valve arrangement is connected between an outlet of the pump and the bypass node and is responsive to an amount of fluid flow through the supply conduit to the plurality of hydraulic functions, wherein as the amount of fluid flow increases, the valve arrangement causes fluid flow to the bypass node to decrease. Thus the pressure at the bypass node varies as a function of the operation of the control valves.

20 Claims, 5 Drawing Sheets

FLOW SENSING BASED VARIABLE PUMP CONTROL TECHNIQUE IN A HYDRAULIC SYSTEM WITH OPEN CENTER CONTROL VALVES

CROSS-REFERENCE TO RELATED APPLICATION

Not applicable.

STATEMENT CONCERNING FEDERALLY SPONSORED RESEARCH OR DEVELOPMENT

Not applicable.

BACKGROUND OF THE INVENTION

1. Field of the Invention

The present invention relates to hydraulic system for equipment, such as off-road construction and agricultural vehicles, and more particularly to apparatus controlling a variable displacement pump used in such systems in a manner that enables a selected hydraulic function to have priority with respect to using pressurized fluid provided by that pump.

2. Description of the Related Art

With reference to FIG. 1, a backhoe-loader 10 is a common type of earth moving equipment that has backhoe assembly 20 attached to the rear of a tractor 15. The backhoe assembly 20 comprises a bucket 12 attached to the end of an arm 13 which in turn is coupled by a boom 14 to the frame of a tractor 15. The bucket 12 can be replaced with other work heads. A first hydraulic actuator 16 causes the bucket 12 to tilt with respect to an arm 13, and a second hydraulic actuator 17 causes the arm to pivot at the remote end of the boom. The boom 14 is raised and lowered with respect to the frame of a tractor 15 by a third hydraulic actuator 18. A joint 21 enables the backhoe assembly 20 to pivot left and right with respect to the rear end of the tractor 15, which motion is referred to as "swing" or "slew". A fourth hydraulic actuator 19 is attached on one side of the frame of the tractor 15 and to the boom 14 and provides the drive force for the pivoting motion of the backhoe assembly 20.

In the exemplary backhoe-loader 10, the first through fourth hydraulic actuators 16-19 are cylinder-piston assemblies, however other types of hydraulic actuators, such as a hydraulic motor can be used with the present invention. Also on larger backhoes, a pair of hydraulic cylinders are attached on opposite sides of the tractor 15 to pivot the backhoe assembly.

A pair of stabilizers 22, only one of which is visible in the drawing, are located on opposite sides of the rear of the tractor 15 and are lowered to the ground during digging to support the tractor. Additional hydraulic actuators 23 are employed to raise and lower the stabilizers 22. The front wheels 24 of the backhoe are steered by another hydraulic actuator, not visible in FIG. 1.

The backhoe-loader 10 also has a loader assembly 25 attached to the front of the tractor 15. The loader assembly 25 comprises a load bucket 27 pivotally coupled to the forward end of a lift arm 26 that has a rearward end that is pivotally coupled to the tractor 15. A lift hydraulic actuator 28 raises and lowers the lift arm 26 and a load hydraulic actuator 29 pivots the load bucket 27 up and down at the end of the lift arm 26.

The flow of hydraulic fluid to and from each of the hydraulic actuators 16-19, 23, 28 and 29 is supplied through valves that are controlled by the backhoe operator. The pressurized fluid to drive the hydraulic actuators is supplied by a pump that is driven by the engine of the tractor. For greater efficiency, a variable displacement pump is used so the pressure of the fluid can be varied to be no greater than the pressure level required to drive the hydraulic actuator against the load forces applied to them. At times when the cylinders are not operating or when only low pressure is required, the displacement of the pump can be set so that high pressure fluid will not be produced and then wasted by merely being dumped into the fluid tank of the hydraulic system. In order to achieve optimal efficiency, the displacement of the pump has to be controlled in relation to the level of pressure required to drive the hydraulic actuators.

SUMMARY OF THE INVENTION

A hydraulic system has a pump that draws fluid from a tank and sends the fluid under pressure through an outlet. The displacement of the pump varies in response to pressure applied to a control port. The fluid flow from the outlet is used to operate a plurality of hydraulic functions. Each hydraulic function has a hydraulic actuator and an open-center type control valve that controls flow of fluid from the pump to the hydraulic actuator.

A bypass node is operatively coupled to the control port so that changes in pressure at the bypass node varies displacement of the pump. The open-center type control valves in the hydraulic functions have variable open-center orifices connected in series to form a bypass passage between the bypass node and the tank. For example, as those control valves open to supply fluid to the associated hydraulic actuator, its variable open-center orifice decreases in size.

A valve arrangement is connected between the outlet of the pump and the bypass node. That valve arrangement is responsive to a supply fluid flow through the supply conduit to the plurality of hydraulic functions, wherein as the supply fluid flow increases, the valve arrangement causes fluid flow to the bypass node to decrease.

In one embodiment, the valve arrangement includes a flow restriction through which fluid flows from the pump outlet into a supply conduit to which the plurality of hydraulic functions connect. A variable pressure compensated orifice provides a fluid path between the supply conduit and the bypass node and operate to restrict fluid flow through the bypass passage. As the pressure across the variable pressure compensated orifice decreases, that orifice becomes proportionally smaller, thereby decreasing the fluid flow through the bypass passage. In a specific version of this embodiment, the variable pressure compensated orifice comprises a compensator valve connected in series with a flow control valve. The compensator valve opens proportionally in response to a pressure differential across the compensator valve. The flow control valve prevents flow through the bypass passage from exceeding a predefined level.

In another embodiment of the hydraulic system, the valve arrangement is implemented by a flow controller valve that has a variable supply orifice through which fluid flows from the outlet of the pump to the supply conduit, and has a variable bypass orifice through which fluid flows from the pump outlet to the bypass node. For example, the flow controller valve is configured so that as the variable bypass orifice decreases in size as size of the variable supply orifice increases.

DETAILED DESCRIPTION OF THE INVENTION

The term "directly connected" as used herein means that the associated components are connected together by a conduit without any intervening element, such as a valve, an orifice or other device, which restricts or controls the flow of fluid beyond the inherent restriction of any conduit. If a component is described as being "directly connected" between two points or elements, that component is directly connected to each such point or element.

Figure 1:
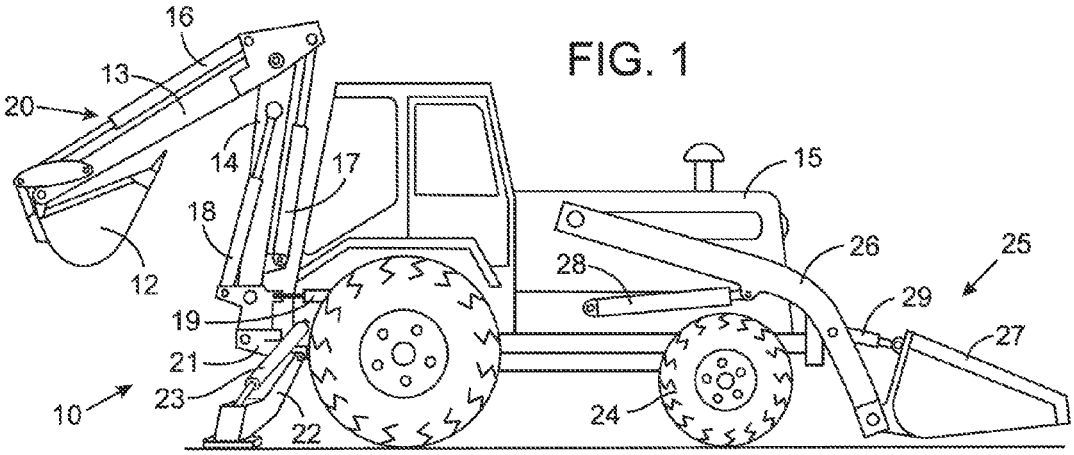
FIG. 1 is a side view of a backhoe.

Although the present invention is being described in the context of use on a backhoe-loader such as the one shown in FIG. 1, it can be implemented on other hydraulically operated machines.

Figure 2:
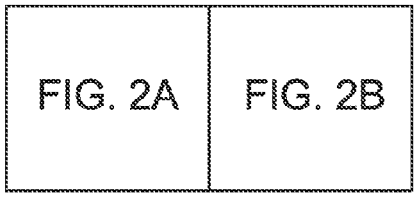
FIG. 2 is composed of two parts FIG. 2A and FIG. 2B that combined form a schematic diagram of a hydraulic circuit for a backhoe that incorporates the present invention.
Figure 2A:
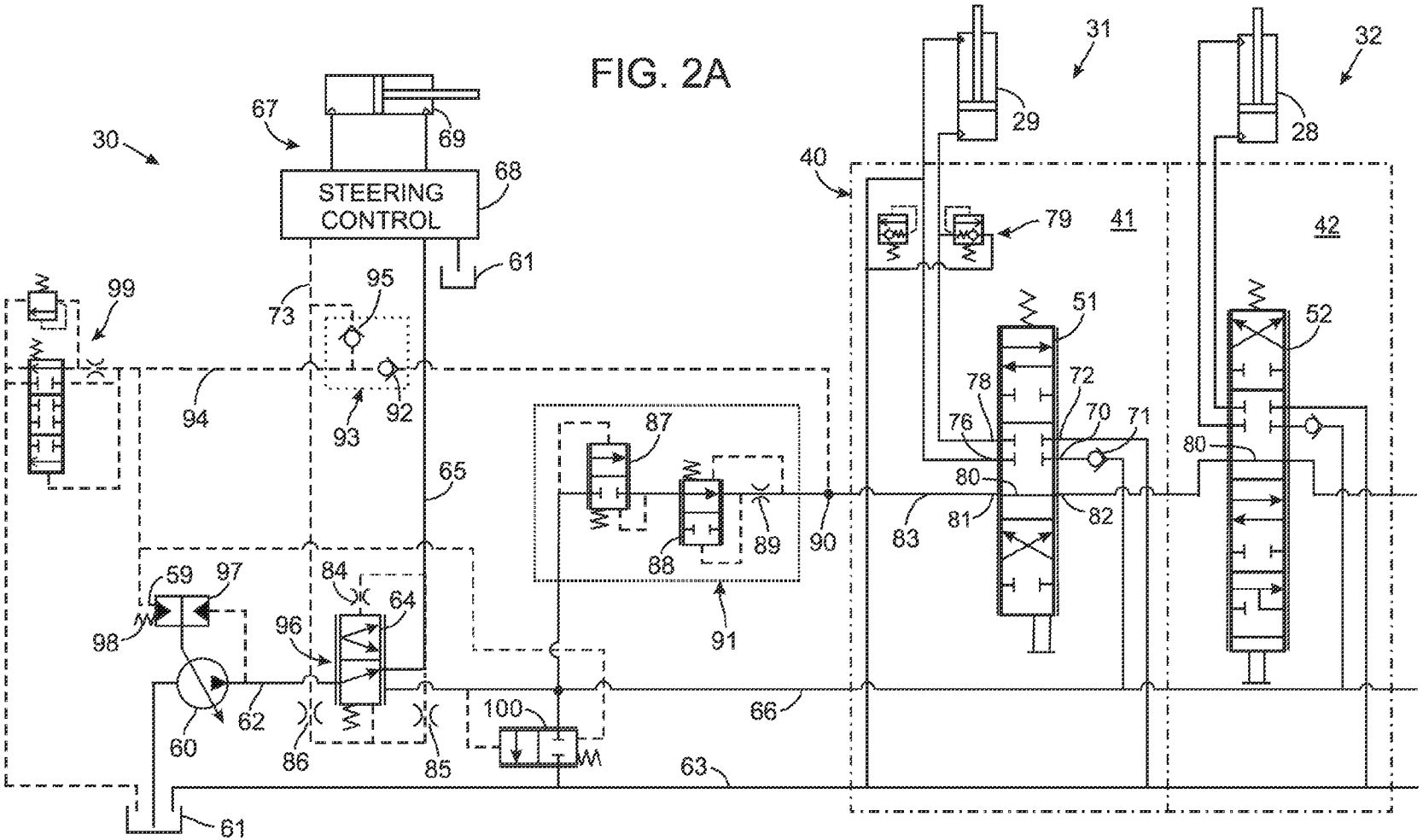

Referring to FIGS. 2A and B, a first hydraulic system 30 for the backhoe-loader 10 has a steering function 67, two loader hydraulic functions 31 and 32, and six backhoe hydraulic functions 33-38, although a greater or lesser number of such functions may be used in other hydraulic systems that utilize the present invention.

With particular reference to FIG. 2A, the loader hydraulic functions include a load function 31 and a lift function 32. The load function 31 includes the load hydraulic actuator 29, for the load bucket 27, and a load valve unit 41. Fluid flow to and from the load hydraulic actuator 29 is controlled by a load control valve 51 within the load valve unit 41. The lift function 32 comprises the lift hydraulic actuator 28, for the lift arm 26, and a lift valve unit 42. Fluid flowing to and from the lift hydraulic actuator 28 is controlled by a lift control valve 52 within the lift valve unit 42. The load control valve 51 is an open-center, three-position valve and the lift control valve 52 is an open-center, four-position valve with a float position. Those control valves may be spool type valves, for example. The load valve unit 41 and the lift valve unit 42 combine to form a loader control valve assembly 40 that may have a single monolithic body or physically separate valve sections attached side by side.

Figure 2B:
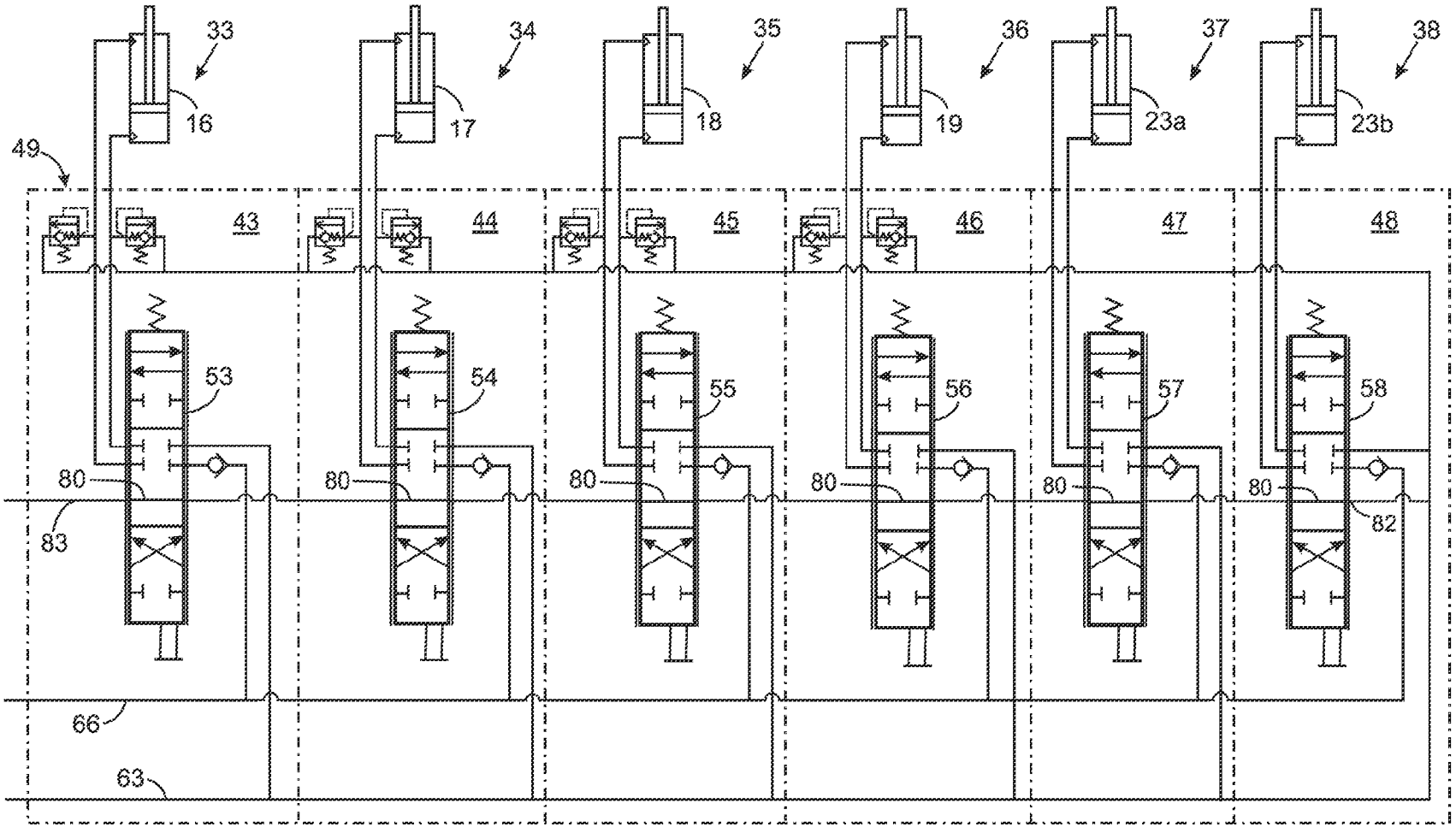

With reference to FIG. 2B, the backhoe hydraulic functions comprise a bucket function 33 that includes the first hydraulic actuator 16 connected to a bucket valve unit 43, and an arm function 34 that has the second hydraulic actuator 17 coupled to an arm valve unit 44. A boom function 35 includes the third hydraulic actuator 18 and a boom valve unit 45. A slew function 36 comprises the fourth hydraulic actuator 19 for swinging the entire backhoe assembly 20 and a slew valve unit 46. There are left and right stabilizer functions 37 and 38, respectively, each comprising one of the hydraulic actuators 23*a* or 23*b* and a stabilizer valve unit 47 or 48. The six valve units 43-48 combine to form a backhoe control valve assembly 49, that has a structure similar to that of the loader control valve assembly 40.

Each of the six valve units 43, 44, 45, 46, 47 and 48 in the backhoe control valve assembly 49 has a separate open-center, three-position control valve 53, 54, 55, 56, 57 and 58 respectively. The control valves 51, 52, 53, 54, 55, 56, 57 and 58 control the flow of fluid between the associated hydraulic actuator 28, 29, 16, 17, 18, 19, 23*a*, and 23*b*, respectively, and both a variable-displacement pump 60 and a tank 61.

The variable-displacement pump 60 draws fluid from the tank 61 and furnishes that fluid under increased pressure from an outlet into an outlet passage 62. The pump 60 is of a type such that the output pressure is equal to a pressure applied to a control port 59 plus a fixed predefined amount referred to as the "pump margin". The pump 60 increases or decreases its displacement in order to maintain the pump margin. Fluid flows into the tank 61 through a return conduit 63.

The outlet passage 62 from the pump 60 is connected to the inlet of a two-position proportional priority valve 64. One outlet of that valve is connected to a first supply conduit 65 and the other outlet is connected to a second supply conduit 66. The first supply conduit 65 provides fluid to the steering function 67 on the tractor 25, which is considered as the primary function as the priority valve 64 gives the steering function fluid use preference over the other functions. The steering function 67 includes steering control 68 which responds to a user input by operating a steering hydraulic actuator 69 that turns the direction of the front wheels 24. The priority valve 64 is pilot operated by pressures in the first supply conduit 65 and in a steering load sense conduit 73 from the steering function 67. As is common practice, the pressure in the steering load sense conduit 73 corresponds to the pressure produced in the steering hydraulic actuator 69 by external forces that resist turning the wheels 24 to steer the tractor 15. The first supply conduit 65 is coupled by a first orifice 84 to apply pressure to first end of the priority valve 64. The pressure is applied to the opposite second end of the priority valve 64 through a second orifice 85 from the first supply conduit 65 and from the steering load sense conduit 73 through a third orifice 86.

When pressure in the first supply conduit 65 applied to the first end is less than the combined force from the pressure and a spring that act on the second end, the priority valve 64 moves toward a position in which the fluid from the pump outlet passage 62 is conveyed only to the first supply conduit 65. Otherwise when pressure applied to the first end is greater than the combined force acting on the second end, the priority valve 64 moves toward another position in which the fluid from the outlet passage 62 is conveyed to both the first and second supply conduits 65 and 66. The significance of operation of the priority valve 64 will be explained hereinafter.

The second supply conduit 66 extends through the two valve units 41 and 42 in the loader control valve assembly 40 and the six valve units 43-48 in the backhoe control valve assembly 49. Those valve units 41-48 are parts of what are considered as the secondary hydraulic functions 31-38. The second supply conduit 66 also is coupled to a bypass node 90 by a pressure compensated orifice (PCO) 91, that comprises a proportional compensator valve, a proportional flow control valve 88, and a sensing orifice 89 connected in series.

Referring to FIG. 2A, the load control valve 51 for the load function 31 will be described in detail with the understanding that the description also applies to the lift control valve 52 and the six control valves 53-58 in the backhoe control valve assembly 49. The load control valve 51 has a supply port 70 that is coupled by a load check valve 71 to the second supply conduit 66. The load check valve 71 which prevents fluid flow from the control valve back into second supply conduit 66 when a large load acts on the hydraulic actuator 29 connected to that valve. A tank port 72 is connected directly to the return conduit 63. A variable metering orifice within the load control valve 51 connects the supply port 70 to one of two workports 76 and 78 depending upon the direction that the lift control valve is moved from the center, neutral position, that is illustrated. The two workports 76 and 78 connect to different ports of the hydraulic actuator 29 in the load function 31. Both workports 76 and 78 are closed when the load control valve 51 is in the center position. Note that some of the control valves, such as the load control valve 51 have a pair of pressure relief valves 79 connected to their workports 76 and 78.

The bypass node 90 is connected to a bypass inlet 81 of the load control valve 51. In the center position of the load control valve 51, a variable open-center orifice 80 connects the bypass inlet 81 to a bypass outlet 82 and the open-center orifice closes proportionally as the valve is displaced from the center position. The open-center orifices 80 of all the control valves 51-58 are connected in series to form the bypass passage 83 that provides fluid communication between the bypass node 90 and the return conduit 63 when all the control valves are in the center position. In that series, the bypass node 90 is directly connected to the bypass inlet 81 of the load control valve 51, and the bypass outlet 82 of the sixth control valve 58 in the backhoe control valve assembly 49 is directly connected to the return conduit 63, see FIG. 2B. As the load control valve 51 moves from the center position, the open-center orifice 80 closes in proportion to the displacement of the valve spool.

A first load sensing check valve 92 allows fluid to flow only in a direction from the bypass node 90 into a primary load sense conduit 94. A second load sensing check valve 95 is connected to allow fluid flow only in a direction from the steering load sense conduit 73 into the primary load sense conduit 94. The first and second load sensing check valves 92 and 95 form a logic element 93 that applies the greater one of the pressures in the steering load sense conduit 73 and the bypass node 90 to the primary load sense conduit 94. Other components, such as a shuttle valve, can be used to perform the function of the logic element 93.

The primary load sense conduit 94 is connected to a control port 59 of a displacement actuator 97. The displacement actuator 97 varies the displacement of the pump 60 in response to the pressure differential between the primary load sense conduit 94 and the outlet passage 62, so that the pressure in the outlet passage equals the pressure in the primary load sense conduit plus the fixed amount of the pump margin. The pump margin amount is defined by a spring 98 of the displacement actuator 97. The displacement actuator 97 may be incorporated into the pump in which case the control port 59 is located on the pump housing.

A pressure compensated drain regulator 99 is connected between the primary load sense conduit 94 and the tank 61 and opens in response to a pressure in the primary load sense conduit. The flow area of the pressure compensated drain regulator 99 decreases when pressure in the primary load sense conduit 94 (the load sense pressure) increases to maintain a constant relatively small flow to the tank. When all the secondary hydraulic functions 31-38 are inactive, the pressure compensated drain regulator 99 bleeds off pressure in the primary load sense conduit, thereby reducing the pump output pressure at that time. The pressure compensated drain regulator 99 incorporates a relief valve which prevents pressure in the primary load sense conduit 94 from reaching an unacceptable level, by releasing excessive pressure to the tank. U.S. Pat. No. 7,854,115 describes one embodiment of this pressure compensated drain regulator 99.

A flushing valve 100 comprises a proportional, two-position valve that is connected between the second supply conduit 66 and the return conduit 63. The pressure in the second supply conduit 66 is applied to a first end of the pressure compensator valve and the pressure in the primary load sense conduit 94 is applied to a second end of the pressure compensator along with the force of a spring. The valve in the flushing valve 100 opens when pressure in the second supply conduit 66 exceeds the combined force from the spring and the pressure in the primary load sense conduit 94. For example, when all the hydraulic functions 31-38 are inactive, the minimum output of the pump 60 may be greater than the combined flow through the bypass passage 83 and the pressure compensated drain regulator 99 connected to the primary load sense conduit 94. In that case, the additional pump output flow is conveyed through the flushing valve 100.

First Hydraulic System Operation

The priority valve 64 gives the steering function 67 priority over the use of the fluid supplied by the pump 60. That is, when the steering function 67 is active and demanding flow, the priority valve 64 shifts proportionally to covey a required amount of fluid flow into the first supply conduit 65 and decrease the amount of flow into the second supply conduit 66. Under an extreme condition, the priority valve 64 shifts into the position illustrated in FIG. 2A in which all of the pump output is directed into the first supply conduit 65 for use by the steering function 67.

Most of the time, however, the steering function 67 is either inactive or not demanding the entire output of the pump 60 and at least some of the pump output flow is directed into the second supply conduit 66. That fluid flow is available to power the hydraulic actuators in the secondary hydraulic functions 31-38. To power a particular hydraulic actuator, the control valve 51-58 for that function is moved from the illustrated neutral, center position toward one of the end positions, thereby applying fluid from the second supply conduit 66 to one port of the associated hydraulic actuator 16-19, 23*a*, 23*b*, 28 or 29, and fluid from the other actuator port flows into the return conduit 63 that leads to the tank 61. The amount that the respective control valve moves proportionally controls the fluid flow to and from the respective hydraulic actuator in a conventional manner.

The first hydraulic system 30 includes a unique open-center, load sense technique for controlling the pump displacement. The load sensing mechanism is the output of the pump 60 coupled through a series connection of a supply orifice 96 (e.g., the priority valve 64), a pressure compensated orifice 91, and the bypass passage 83 to the tank 61. That bypass passage 83 includes the variable open-center orifices 80 of the control valves 51-58. As noted previously, when all the control valves 51-58 are in the neutral, center position, the bypass passage 83 is fully open from the bypass node 90, adjacent the first control valve 51, to the connection of the bypass outlet 82 of the eighth control valve 58 to the return conduit 63. As each control valve 51-58 moves from the center position to operate a hydraulic actuator, the area of its open-center orifice 80 decreases proportionally in size, thereby providing a greater restriction to the fluid flow through the bypass passage 83. Therefore, the flow area through the bypass passage 83 decreases as the displacement of the control valves 51-58 increase.

Figure 3:
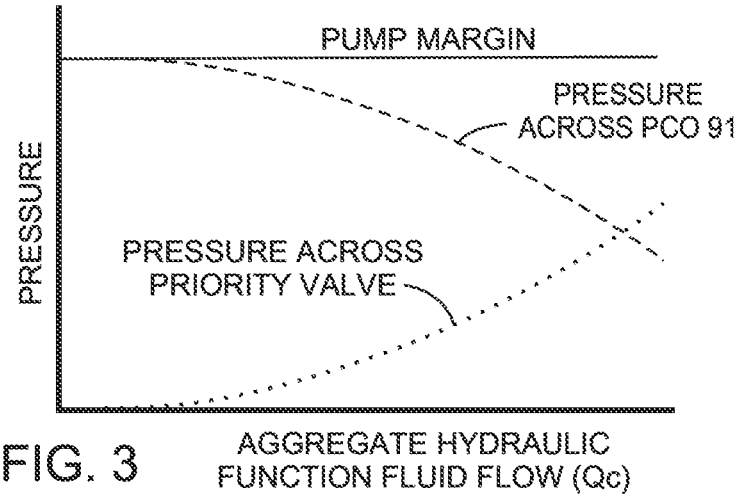
FIG. 3 is a graph depicting variation of pressure across two components in the hydraulic circuit as the fluid flow consumed by the hydraulic functions changes.

The pressure drop across a flow restriction, provided by the supply orifice 96 in the priority valve 64 between the pump and the second supply conduit 66, is a function of the fluid flow which closely approximates that of a true orifice. In applications of the present invention that do not employ a priority valve 64, a fixed supply orifice can be used to provide this flow restriction and pressure drop. With reference to FIG. 3, the solid line represents the pump margin pressure at the outlet of the pump 60 and dotted line indicates the amount of the pump margin pressure drop across the supply orifice 96 as a function of the aggregate fluid flow Qc consumed by all the secondary hydraulic functions 31-38. A change in the pressure drop across the supply orifice affects the remaining amount of the pump margin pressure that appears as a pressure drop across the pressure compensated orifice (PCO) 91, as indicated by the dashed line.

Figure 4:
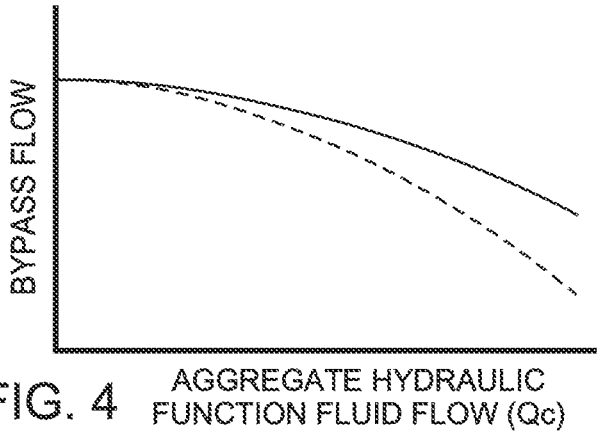
FIG. 4 graphically illustrates the relationship between fluid flow through a bypass passage in the hydraulic circuit and the fluid flow consumed by the hydraulic functions.

With continuing reference to FIGS. 2A and 3, at low levels of the aggregate fluid flow Qc, the pressure drop across the supply orifice 96 created by the priority valve 64 is small creating enough pressure drop across the pressure compensated orifice 91 to open compensator valve 87 against its spring force and provide free flow through the pressure compensated orifice. As the aggregate fluid flow increases, the pressure drop across the supply orifice 96 also increases, which decreases the available pressure in the second supply conduit 66. That supply pressure decrease causes the pressure across the compensator valve 87 to decrease thereby proportionally closing that valve and decreasing the flow through the pressure compensated orifice 91 and the bypass passage 83. FIG. 4 graphically illustrates the relationship between the fluid flow though the bypass passage 83 and the aggregate fluid flow Qc consumed from the second supply conduit 66 by all the active secondary hydraulic functions 31-38. That relationship, if a fixed orifice is used in place of the variable pressure compensated orifice 91, is denoted by the solid line in FIG. 4. In contrast, the dashed line designates the smaller flow through the variable pressure compensated orifice 91. This closure of the compensator valve 87 decreases the bypass flow, which results in a lower pressure at the bypass node 90.

The effects of the load sensing mechanism cause the pressure at the bypass node 90 to vary as a function of the control valve displacement and the flow through the bypass passage 83 formed by the open-center orifices 80 of all the control valves 51-58. The pressure at the bypass node 90 is applied to the logic element 93 as the load sense pressure for the secondary hydraulic functions 31-38.

Figure 5:
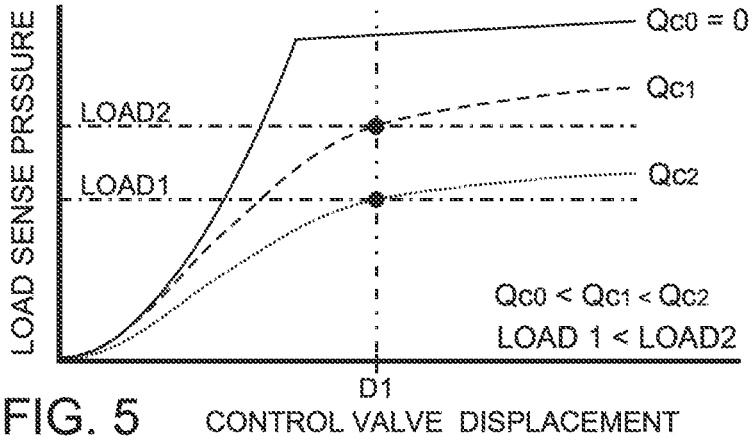
FIG. 5 is a graph depicting the relationship between a load sense pressure produced in the hydraulic circuit and displacement of the control valves in the hydraulic functions.

FIG. 5 denotes the relationship of the displacement of one of the control valves 51-58 and the load sense pressure produced at the bypass node 90. Consider the situation in which a single hydraulic function is operating. For a given displacement D1 of the control valve (i.e. amount that the valve is open), as the force exerted by a load on the associated hydraulic actuator increases (e.g., from LOAD1 to LOAD2), the flow to the actuator decreases. Thus the aggregate fluid flow from the second supply line decreases (e.g., from Qc2 to Qc1). This results in the pressure at the bypass node 90 increasing which is communicated into the primary load sense conduit 94 as an increased load sense pressure. As a result, the load sense pressure is a function of control valve displacement and the aggregate fluid flow Qc in a manner that provides a load sense signal which indicates the displacement of the pump required to properly drive the active hydraulic actuators.

Consider another situation in which all the secondary hydraulic functions 31-38 are inactive while the steering function 67 is active. At this time, operation of the steering function 67 produces a pressure in the steering load sense conduit 73 that commands the pump 60 to increase its displacement and thereby the pump output flow. This results in greater flow being directed into the second supply conduit 66, which flow can only continue through the bypass passage 83 formed in the open-center orifices 80 of the secondary function control valves 51-58. That increased flow normally will be wasted into tank 61.

The flow control valve 88, however, limits the maximum open-center flow through the bypass passage 83 to a predefined level. As a result, the amount of flow wasted to the tank 61 in this situation is lessened and the efficiency of the hydraulic system is enhanced. It should be understood that when the steering function 67 is not operating, the flow control valve 88 is in the fully open position that provides minimal restriction to the flow through the bypass passage 83. When the steering control is active, however, the flow control valve 88 begins closing to limit the bypass passage flow to the predefined level. Generally when the compensator valve 87 is operating, the flow control valve 88 is in the fully open position.

As noted previously if the hydraulic system does not provide certain function priority to the use of fluid from the pump a fixed orifice can be used in place of the supply orifice 96 provided by operation of the priority valve 64 in FIG. 2A.

Second Hydraulic System

Figure 6:
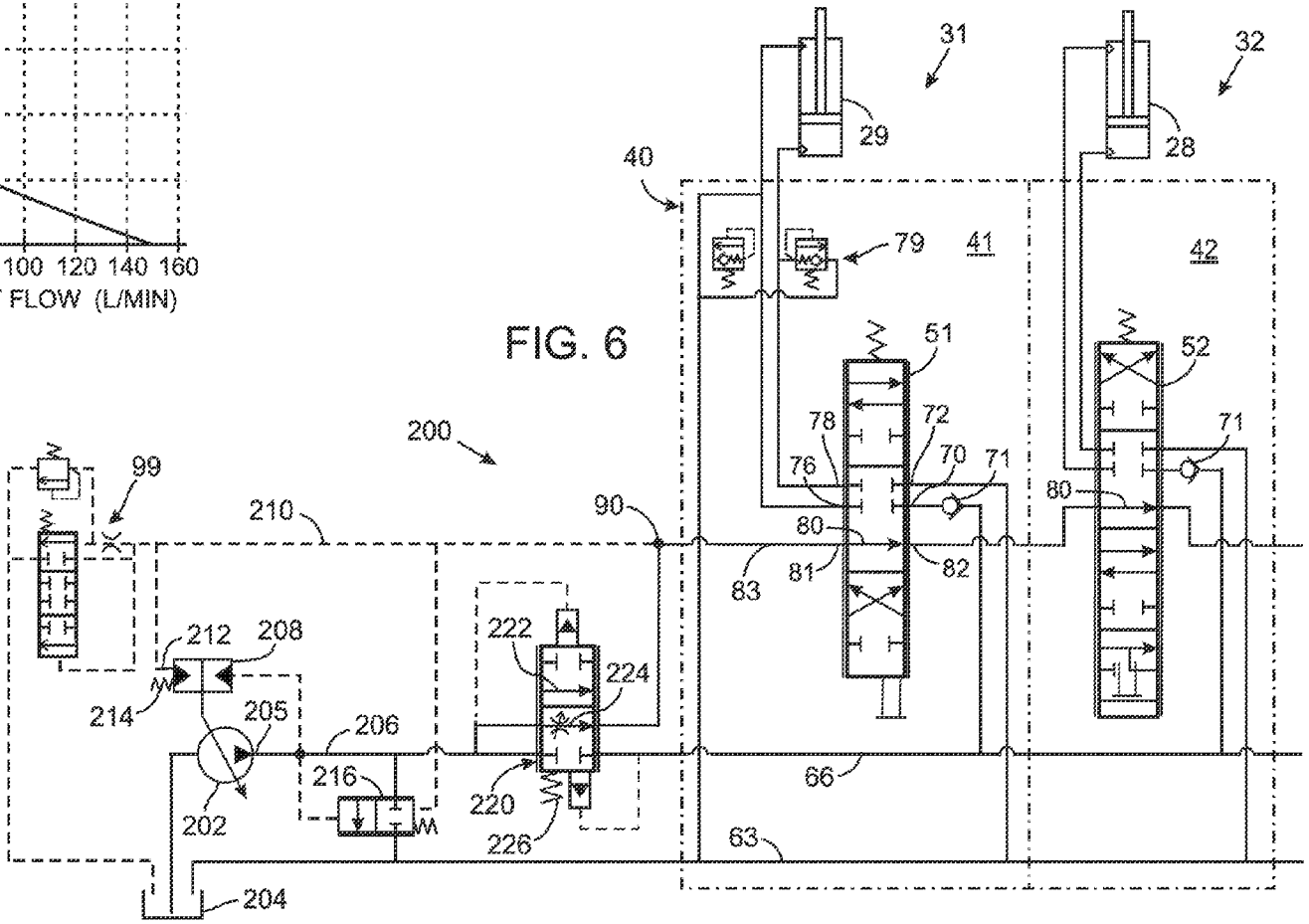
FIG. 6 is a schematic diagram of part of a second hydraulic circuit for a backhoe with the remaining part shown in FIG. 2B.

FIG. 6 presents another alternative where a priority valve 64 is not used. A second hydraulic system 200 is provided for a backhoe-loader that is similar to machine 10, but without a steering function powered by that hydraulic system. Thus the second hydraulic system 200 still includes the loader control valve assembly 40, as well as the backhoe control valve assembly 49 (see FIG. 2B). The components in the second hydraulic system 200 that are the same as in the first hydraulic system 30 have been assigned identical reference numerals. Specifically the details of the loader control valve assembly 40 and the backhoe control valve assembly 49 are identical to the like assemblies shown in and described in respect of FIG. 2A and 2B. The description of those assemblies will not be repeated in its entirety here. Nevertheless, note that the supply conduit 66 conveys fluid for powering the hydraulic functions 31-38 on the backhoe-loader and the bypass passage 83 is formed between the bypass node 90 and the tank 204 by the open-center orifices 80 of all the function control valves 51-58 connected in series.

The second hydraulic system 200 in FIG. 6 has a variable-displacement pump 202, which draws fluid from a tank 204 and furnishes that fluid under increased pressure from an outlet 205 into an outlet passage 206. The displacement of the pump 202 is varied by a displacement actuator 208 in response to a pressure differential between a control port 212 and the pump outlet 205. The control port 212 receives pressure from a load sense conduit 210. Operation of the displacement actuator 208 ensures that the pressure at the pump outlet 205 equals the pressure in the load sense conduit 210 plus the fixed pump margin pressure. The magnitude of the pump margin pressure is defined by the force from a spring 214 acting on the displacement actuator 208. The displacement actuator 208 may be incorporated into the pump in which case the control port 212 is located on the pump housing.

A proportional, two-position flushing valve 216 is connected between the pump outlet passage 206 and the return conduit 63 through which fluid from the flushing valve and the hydraulic functions 31-38 flows back into the tank 204.

The outlet passage 206 from the pump 202 is connected to an inlet of a two-position, four-way proportional flow controller valve 220 that has a pair of outlets connected to the supply conduit 66 and to the bypass node 90 of the bypass passage 83. In selected positions, the flow controller valve 220 provides a first flow path between the valve's inlet and the supply conduit 66 and a second flow path between the valve's inlet and the bypass passage 83. The first flow path through the flow controller valve 220 has a variable supply orifice 222 and the second flow path has a variable bypass orifice 224.

The flow controller valve 220 is configured so that the supply orifice 222 acts to sense the supply conduit flow and the valve position changes in response to that flow. Specifically, the supply orifice 222 opens to a larger size in response to the greater demand for fluid by the hydraulic functions 31-38, and the bypass orifice 224 correspondingly decreases in size to restrict flow to the bypass node 90, as will be described further hereinafter. That action alters the fluid flow through the bypass passage 83.

Figure 7:
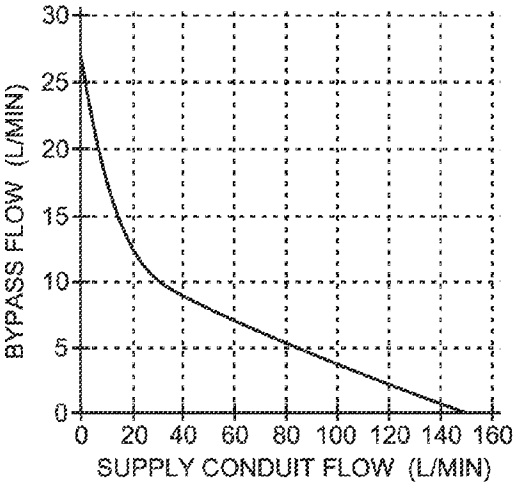
FIG. 7 graphically depicts the relationship between fluid flow to hydraulic functions and fluid flow in a bypass passage which flows change with operation of a flow controller valve in the second hydraulic circuit.

The flow controller valve 220 governs the flow through the open center bypass passage 83 so that it is a proportion of the supply flow through the hydraulic function control valves 51-58 according to a predefined relationship. That relationship is depicted graphically in FIG. 7. Note that the flow in the bypass passage 83 decreases as the flow through the control valves 51-58 to the hydraulic actuators increases. Also note that the flow through the bypass passage 83 is relatively low (e.g., less than 30 liters per minute) under all operating conditions in comparison to the maximum pump output flow (e.g., 150 liters per minute). As a consequence, the forces exerted by the bypass flow on the open-center orifices 80 are relatively small and do not unduly impact operation of the control valves 51-58, thereby facilitating control of the hydraulic functions.

Referring again to FIG. 6, the output from the pump 202 flows through the flow controller valve 220 to the supply conduit 66 and/or the bypass passage 83 in varying amounts depending on the position of that valve. The pressure at the pump outlet 205 is controlled at a fixed amount above the load sense pressure detected at bypass node 90 that is downstream of the flow controller valve. Therefore, the flow in the, bypass passage 83 is set by the pressure drop across the flow controller valve and the size of the bypass orifice 224 managed by the flow controller valve 220.

The flow controller valve 220 senses the flow which is passing via the supply conduit 66 to the hydraulic functions 31-38. The spring 226 effectively sets the pressure drop across the flow controller valve. The supply conduit pressure is applied to the same end of the flow controller valve 220 as the spring force and pump outlet pressure acts on the opposite end of the flow controller valve, which pressures are respectively downstream and upstream of the supply orifice 222. Because the area of the variable supply orifice 222 is predetermined for any given position of the flow controller valve 220 according to the orifice equation, the flow through that orifice sets the position of the flow controller valve. The orifice equation is:

$$Q=K*A*\sqrt{\Delta P}$$

where K is a constant that incorporates a flow coefficient(s), A is the area of the orifice, and ΔP is the pressure differential across the orifice.

Since the supply and bypass orifices 222 and 224 in the flow controller valve 220 are functionally coupled together, there is a relationship between the areas of those orifices. Therefore, for any flow to the hydraulic function 31-38, the position of the flow controller valve is set, which in turn sets the position and therefore the area of the bypass orifice 224 that controls the bypass passage flow.

Second Hydraulic System Operation

When all the control valves 51-58 of the second hydraulic system 200 are in the neutral, center position, there is no fluid flow through the supply conduit 66 to the hydraulic actuators 16-19, 23, 28 and 29. The flow controller valve 220 responds to that zero supply flow by moving to a position in which the bypass orifice 224 has a maximum area. As a result, a maximum amount of flow through the bypass passage 83 may occur in this state. Note that in the center position of each control valve 51-58, the associated open-center orifice 80 also is at a maximum opening.

The bypass passage flow passes in series through the open-center orifices 80 of the control valves 51-58 and back to the tank 204 with relatively low pressure. That low pressure appears at the bypass node 90 from which the pressure is conveyed via the load sense passage 210 to the displacement control port 212 of the pump 202. The output pressure of the pump is maintained at the fixed margin pressure above that control port pressure by modulating the pump outlet flow.

If one or more of the control valves 51-58 is partially displaced from the center position, flow through the bypass passage 83 is restricted to some degree by that valve's variable open-center orifice 80. As a result, the load sense pressure from the bypass node 90 increases, and the pump output pressure is increased by the action of the displacement actuator 208.

Assume for example that the first control valve 51 for the load function 31 is displaced from the center position. Initially, when the resultant pump output pressure is not great enough to overcome load pressure acting on the load check valve 71 at the first control valve 51, fluid will not pass through that valve to the associated hydraulic actuator 29. In this situation, the flow controller valve 220 senses that there still is no supply conduit flow to the control valves and thus the position of the flow controller valve is set so that the variable bypass orifice 224 remains at the maximum area. In this state a sizeable bypass flow passes through the bypass passage 83 and on to the tank 204.

As the first control valve 51 is displaced farther from the center position, the resultant decrease of the open-center orifice 80 further restricts the flow in the bypass passage 83. The load sense pressure at the bypass node 90 rises accordingly, causing a further increase in the pump output pressure. The pump output pressure eventually increases to a high enough level to overcome the load force, thereby opening the associated load check valve 71. As a result, fluid begins to flow from the supply conduit 66 through the first control valve 51 to the respective hydraulic actuator 29. The flow controller valve 220 senses that flow and responds by moving to a position related to the flow level, which movement produces a corresponding adjustment (a decrease) of the size of the bypass orifice 224 leading to the bypass node 90. Because the pump 202 is maintaining a constant pressure drop from its outlet 205 to the load sense control port 212, i.e., across the second variable orifice 224 of the flow controller valve 220, the flow in the bypass passage 83 will change at this time. Typically, the flow through the supply conduit 66 to the hydraulic actuators increases, the fluid flow through the open-center bypass passage decreases.

In this manner, the flow controller valve 220, by means of the supply orifice 222, senses the amount of fluid flow to the hydraulic functions 31-38 and modulates the fluid flow through the bypass passage accordingly.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. A hydraulic system in which fluid is drawn from a tank by a pump having a displacement that varies in response to pressure applied to a control port, wherein fluid flow produced at an outlet of the pump is controlled to operate a plurality of hydraulic functions, each hydraulic function has a hydraulic actuator and an open-center type control valve that controls flow of fluid from a supply conduit to the hydraulic actuator, said hydraulic system further comprising:

a bypass node operatively coupled to the control port so that pressure at the bypass node controls displacement of the pump, wherein the open-center type control valves in the hydraulic functions have variable open-center orifices connected in series to form a bypass passage between the bypass node and the tank; and a valve arrangement connected between the outlet of the pump and the bypass node, and being responsive to a supply fluid flow through the supply conduit to the plurality of hydraulic functions, wherein as the supply fluid flow increases, the valve arrangement causes fluid flow to the bypass node to decrease.

2. The hydraulic system as recited in claim 1 wherein the valve arrangement comprises a flow controller valve having a variable supply orifice through which fluid flows from the outlet of the pump to the supply conduit, and a variable bypass orifice through which fluid flows from the outlet of the pump to the bypass node.

3. The hydraulic system as recited in claim 2 wherein the flow controller valve decreases size of the variable bypass orifice as size of the variable supply orifice increases.

4. The hydraulic system as recited in claim 2 wherein the flow controller valve is pilot-operated in response to a pressure differential that is a function of an amount of fluid flow from the outlet of the pump into the supply conduit.

5. The hydraulic system as recited in claim 2 wherein the flow controller valve comprises a pilot-operated valve in which the variable bypass orifice shrinks in response to an amount that pressure at the outlet of the pump is greater than pressure in the supply conduit.

6. A hydraulic system in which fluid is drawn from a tank by a pump having a displacement that varies in response to pressure applied to a control port, wherein fluid flow produced at an outlet of the pump is controlled to operate a plurality of hydraulic functions, each hydraulic function has a hydraulic actuator and an open-center type control valve that controls flow of fluid from the outlet to the hydraulic actuator, said hydraulic system further comprising:

a flow restriction through which fluid flows from the outlet of the pump into a supply conduit to which the plurality of hydraulic functions connect;

a bypass node coupled to the control port for controlling displacement of the pump, wherein the open-center type control valves in the hydraulic functions have a variable open-center orifice connected in series forming a bypass passage between the bypass node and the tank; and a variable pressure compensated orifice providing fluid communication between the supply conduit and the bypass node, and limiting fluid flow through the bypass passage.

7. The control valve assembly as recited in claim 6 wherein the flow restriction comprises a fixed supply orifice.

8. The control valve assembly as recited in claim 6 wherein the flow restriction comprises a priority valve having an input connected to the outlet of the pump, a first valve outlet connected to the supply conduit, and a second valve outlet connected to a further supply conduit to which at least one other hydraulic function is connected.

9. The control valve assembly as recited in claim 8 wherein the priority valve is configured to respond to fluid flow requirements of hydraulic functions connected to the further supply conduit by altering an apportionment of fluid flow from the outlet of the pump to the supply conduit and the further supply conduit.

10. The control valve assembly as recited in claim 6 wherein the variable pressure compensated orifice comprises a pilot-operated valve which opens proportionally in response to a pressure differential across the pilot-operated valve.

11. The control valve assembly as recited in claim 10 wherein the variable pressure compensated orifice further comprises a flow control valve that prevents flow through the bypass passage from exceeding a predefined level.

12. The control valve assembly as recited in claim 6 wherein the variable pressure compensated orifice comprises a compensator valve, a flow control valve and a sensing orifice connected in series, wherein the compensator valve opens proportionally in response to a pressure differential across the compensator valve, and wherein the flow control valve operates in response to a pressure differential across the sensing orifice.

13. A hydraulic system in which fluid is drawn from a tank by a pump having a displacement that varies in response to pressure applied to a control port, wherein fluid flow produced at an outlet of the pump is controlled to operate a plurality of hydraulic functions, each hydraulic function has a hydraulic actuator and an open-center type control valve that controls flow of fluid from the outlet to the hydraulic actuator, said hydraulic system further comprising:

a bypass node operatively coupled to the control port so that pressure at the bypass node controls displacement of the pump, wherein the open-center type control valves have variable open-center orifices connected in series to form a bypass passage between the bypass node and the tank; and a flow controller valve having a variable supply orifice through which fluid flows from the outlet of the pump to the supply conduit, and having a variable bypass orifice through which fluid flows from the outlet of the pump to the bypass node.

14. The hydraulic system as recited in claim 13 wherein the flow controller valve decreases the variable bypass orifice as the variable supply orifice increases.

15. The hydraulic system as recited in claim 13 wherein the flow controller valve is pilot-operated in response to a pressure differential that is a function of an amount of fluid flow from the outlet of the pump into the supply conduit.

16. The hydraulic system as recited in claim 13 wherein the flow controller valve comprises a pilot-operated valve in which the variable bypass orifice shrinks in response to an amount that pressure at the outlet of the pump is greater than pressure in the supply conduit.

17. A method for controlling displacement of a pump in a hydraulic system that has a plurality of hydraulic functions, each hydraulic function includes a hydraulic actuator and an open-center type control valve that controls flow of fluid from a supply conduit to the hydraulic actuator, wherein the open-center type control valves in the hydraulic functions have variable open-center orifices connected in series to form a bypass passage between a bypass node and a tank, said method comprising:

sending fluid from an outlet of the pump through a supply orifice to the supply conduit thereby producing a pressure drop across the supply orifice;

in response to the pressure drop, varying a bypass orifice through which fluid flows from the outlet of the pump to the bypass node, wherein the bypass orifice decreases in size as fluid flow through the supply conduit increases; and applying pressure at the bypass node to a control the displacement of the pump.

18. The method as recited in claim 17 wherein varying the bypass orifice is performed by a flow controller valve that includes the supply orifice and the bypass orifice and which changes positions in response to a pressure differential across the supply orifice, wherein as the pressure differential increases, the supply orifice increases in size and the bypass orifice decreases in size.

19. A method for controlling displacement of a pump in a hydraulic system that has a plurality of hydraulic functions, each hydraulic function includes a hydraulic actuator and an open-center type control valve that controls flow of fluid from a supply conduit to the hydraulic actuator, wherein the open-center type control valves in the hydraulic functions have variable open-center orifices connected in series to form a bypass passage between a bypass node and a tank, said method comprising:

sending fluid from an outlet of the pump through a supply orifice to the supply conduit thereby producing a pressure drop across the supply orifice;

in response to the pressure drop, varying a variable pressure compensated orifice through which fluid flows from the supply conduit to the bypass node, wherein the variable pressure compensated orifice includes a compensator valve that opens proportionally in response to a pressure differential across the compensator valve; and applying pressure at the bypass node to a control the displacement of the pump.

20. The method as recited in claim 19 wherein the variable pressure compensated orifice further includes a flow control valve and a sensing orifice connected in series with the compensator valve, wherein the flow control valve operates in response to a pressure differential across the sensing orifice.

* * * * *